United States Patent [19]

Yasnitsky et al.

[11] 4,347,056

[45] Aug. 31, 1982

[54] METHOD OF MAKING ABSORBABLE SURGICAL THREADS

[76] Inventors: Boris G. Yasnitsky, pereulok Rogatinsky, 56, kv. 1; Galina M. Tsukanova, prospekt Moskovsky, 198/2, kv. 66; Valentin A. Oridoroga, ulitsa Sotsialisticheskaya, 15, all of Kharkov; Jury A. Furmanov, prospekt Nauki, 142, korpus 12, kv. 4, Kiev, all of U.S.S.R.

[21] Appl. No.: 235,053

[22] Filed: Feb. 17, 1981

[51] Int. Cl.[3] ..... D06M 1/00; D06M 1/22

[52] U.S. Cl. ..... 8/116 R

[58] Field of Search ..... 8/116 R

[56] References Cited

U.S. PATENT DOCUMENTS

| | | | |
|---|---|---|---|
| 2,232,990 | 2/1941 | Yackel et al. | 8/116 R |
| 2,496,797 | 2/1950 | Kenyon et al. | 8/116 R |
| 2,537,979 | 1/1951 | Eberl | 8/116 R |
| 3,236,669 | 2/1966 | Williams | 8/116 R |

*Primary Examiner*—Maria Parrish Tungol

*Attorney, Agent, or Firm*—Ladas & Parry

[57] ABSTRACT

A method of making absorbable surgical threads consists in treating cellulose threads with nitrogen oxides, then treating these threads with a protophilic solvent for 1 to 2 hours at a room temperature and holding them at a temperature of 70° to 90° C. for 1 to 2 hours.

4 Claims, No Drawings

METHOD OF MAKING ABSORBABLE SURGICAL THREADS

BACKGROUND OF THE INVENTION

1. Field of the Invention

The present invention relates to a method of making absorbable surgical threads and can be used in medicine biology and veterinary science.

At present absorbable threads are widely used in medical practice. They do not require such a manipulation as thread removal and provide for a proper cosmeticability of the cicatrices resulting from surgical operations.

In order to be successfully used, the absorbable threads should possess a sufficient strength. However, conventional absorbable threads are of inadequate mechanical strength. Therefore efforts are constantly undertaken to develop novel methods of making absorbable threads based on cellulose which are characterized by a higher mechanical strength.

2. Description of the Prior Art

There is known in the art a method of making surgical threads (U.S. Pat. No. 2,537,979) which consists in oxidizing cellulose with nitrogen dioxide. However, as distinct from the method described above, the oxidation here is carried out till the content of carboxyls is 4 to 12.5%. The time of making said surgical sutures is 64 hours. The process is carried out at a temperature of 25° C. Having been treated with nitrogen dioxide, the threads are washed with distilled water and dried. The ratio between the value of the tensile strength of the absorbable threads produced due to the treatment of the initial threads and the value of the tensile strength of the initial threads prior to the treatment is 36.8 to 43.5%.

As a result of the oxidation of the cellulose threads with nitrogen oxides there occurred a destruction of the supermolecular structure of the cellulose threads because of inculation of large molecules of $N_2O_4$, rupture of intermolecular hydrogen bonds cellulose-cellulose and cellulose-water-cellulose, substitution of a part of $C^6H_2OH$-groups by larger $C^6OOH$-groups. Therefore, the surgical absorbable threads produced by said method are of a low mechanical strength and of a high swelling property in biological media.

As noted in the above Patent, such a thread completely lost its strength within 5 days. The testing was carried out in a phosphate buffered solution having a pH of 7.5 at a temperature of 37° C. where a thread is absorbed slower than in living tissues. No testing of the thread placed in living tissues was carried out.

Thus, the above-described method does not provide for the manufacture of absorbable surgical threads having a high mechanical strength and a low swelling property in beological media.

SUMMARY OF THE INVENTION

The object of the present invention is to provide a method of making absorbable surgical threads based on oxidized cellulose, which method makes it possible to upgrade the quality of the absorbable surgical threads, i.e. to improve their mechanical strength and to reduce their swelling property both in water and in biological media.

Other objects and advantages of the present invention will be clear from the following description.

The above and other objects of the invention are attained by that there is provided a method of making absorbable surgical threads consisting in treating cellulose threads with nitrogen oxides, wherein, according to the invention, the threads treated with the nitrogen oxides are further treated with a protophilic solvent for 1 to 2 hours at a room temperature and then held at a temperature of 70° to 90° C. for 1 to 2 hours.

The above treatment of the oxidized cellulose threads provides for a higher degree of ordering of their supermolecular structure, for a larger amount of hydrogen bonds between macromolecules of the oxidized cellulose as well as between the latter and water bonded with cellulose. As a result, the mechanical strength of the oxidized threads improves and the selling property of these same threads in water and biological media decreases.

It is expedient to use as the protophilic solvent a 2 to 10% water solution of ionogenic compound selected from the group consisting of sodium chloride, calcium chloride, calcium acetate and acetic acid; a 2 to 10% aqueous solution of an amphiprotonic polyhydric alcohol selected from the group consisting of glycerol, pentaerytritol, mannite, sorbitol, glucose, saccharose and dextrose; an organic solvent selected from the group consisting of dimethyl formamide, dimethyl sulfoxide and dimethyl acetamide.

DETAILED DESCRIPTION OF THE INVENTION

Absorbable surgical sutures according to the invention were produced in the following way.

Cellulose threads are oxidized with nitrogen oxides in a conventional manner. The cellulose threads may be threads from cotton, flax, viscose, high-module viscose, polynose etc which are characterized by a wide range of thickness and an amount of additions.

The oxidized threads are thoroughly washed with water, whereupon wet threads are placed into a stainless steel reaction vessel having a capacity of 20 liters and filled with a preliminarily prepared protophilic solvent. The threads are held in this reaction vessel for 1 to 2 hours.

The protophilic solvent may be a 2 to 10% water solution of ionogenic compounds such as sodium chloride, calcium chloride, calcium acetate and acetic acid; a 2 to 10% aqueous solution of an amphiprotic polyhydric alcohol such as glycerol, pentaerytritol, mannite, sorbitol, glucose, saccharose and dextrose as well as an organic solvent such as dimethyl formamide, dimethyl sulfoxide, or dimethyl acetamide.

Thereupon the threads are withdrawn from the reaction vessel and placed into a stainless steel chamber having a capacity of 20 liters and blown through with air heated up to a temperature of 70° to 90° C. In this chamber the threads are held for 1 to 2 hours.

The method of the present invention makes it possible to produce absorbable surgical threads whose mechanical strength is 83 to 105% of cellulose threads before oxidation.

The swelling property of the sutures produced according to the invention is reduced down to 20 to 60% as compared with the swelling property of the initial non-oxidized cellulose threads.

EXAMPLE 1

Absorbable surgical sutures were produced according to the invention in the following way.

2.4 kg of complex viscose threads having a size of 60/18 and a tensile strength of 4.75 kg were oxidized with nitrogen oxides in a conventional manner. The oxidized threads were thoroughly washed with water and then tested to determine the content of carboxyls, fixed nitrogen, relative humidity, tensile strength, and degree of swelling in water.

The results of the testing were the following:

| | |
|---|---|
| content of carboxyls, % | 6.5 |
| content of fixed nitrogen, % | 0.12 |
| relative humidity, % | 12.8 |
| tensile strength, kg | 3.35 |
| degree of swelling in water, % | 59.5 |

Thereupon, the wet threads were placed in a reaction vessel having a capacity of 20 liters and filled with a 10% of an aqueous solution of sorbitol in an amount of 15 liters. The threads were held in the reaction vessel for 2 hours, whereupon they were withdrawn therefrom, and placed into a chamber blown through with air heated to a temperature of 80° C., in which chamber the threads were again held for 1.5 hours.

Thus treated threads were again tested to determine the tensile strength and degree of swelling.

The results of the testing are given below:

| | |
|---|---|
| tensile strength, kg | 5.0 |
| degree of swelling, % | 31.1 |

The ratio between the value of the tensile strength of the oxidized treated threads to the value of the tensile strength of the oxidized non-treated threads was 154%, and the ratio between the value of the degree of swelling of the oxidized treated threads to the value of the degree of swelling of the oxidized non-treated threads was 52.3%.

The ratio between the value of the tensile strength of the oxidized treated threads to the value of the tensile strength of the initial viscose threads was 105.3%.

EXAMPLE 2,3

Absorbable surgical threads according to the invention were produced in the following way.

Complex viscose threads having initial properties similar to those described in Example 1 were subjected to oxidation and then to treatment according to the procedure described in Example 1.

The properties of the oxidized non-treated threads are similar to those of Example 1.

| | | Teatment conditions | | |
|---|---|---|---|---|
| No of Example | Protophilic solvent | Time of holding, hours | Temperature of treatment, °C. | Duration of treatment, hours |
| 2 | 2% sodium chloride | 2 | 80 | 1.5 |
| 3 | 2% calcium chloride | 2 | 80 | 1.5 |

| | Properties of the oxidized treated threads | | | | |
|---|---|---|---|---|---|
| | | | Ratio between the indices of oxidized treated threads and the indices of oxidized non-treated threads | | Ratio between the value of the tensile strength of oxidized non-treated threads and the tensile strength of initial threads, % |
| No of Example | Tensile strength, kg | Degree of swelling, % | Tensile strength, % | Degree of swelling, % | |
| 2 | 4.95 | 36.0 | 152.0 | 60.2 | 104.2 |
| 3 | 4.60 | 36.0 | 141.6 | 60.5 | 96.8 |

EXAMPLES 4–12

Absorbable surgical threads according to the invention were produced in the following way.

2.4 kg of viscose threads having a size of 60/18 and a tensile strength of 4.75 kg were oxidized and further treated in accordance with the procedure described in Example 1.

The properties of the oxidized non-treated threads are similar to those of Example 1.

| | | Treatment conditions | | |
|---|---|---|---|---|
| No of Example | Protophilic solvent | Time duration of holding, hours | Temperature of treatment, °C. | Time of treatment, hours |
| 4 | 6% sodium chloride | 1.5 | 80 | 1.5 |
| 5 | 10% calcium chloride | 1.0 | 70 | 2.0 |
| 6 | 6% glycerol | 1.5 | 80 | 1.5 |
| 7 | 6% pentaerytritol | 1.5 | 80 | 1.5 |
| 8 | 2% sorbitol | 2.0 | 90 | 1.0 |
| 9 | 10% sorbitol | 1.0 | 70 | 2.0 |
| 10 | 2% glucose | 2.0 | 90 | 1.0 |
| 11 | 6% saccharose | 1.5 | 80 | 1.5 |
| 12 | 10% dextrose | 1.0 | 70 | 2.0 |

| | Properties of the oxidized treated threads | | | | |
|---|---|---|---|---|---|
| | | | Ratio between the indices of oxidized treated threads and the indices of oxidized non-treated threads | | Ratio between the value of the tensile strength of oxidized non-treated threads and the value of the tensile strength if initial threads, % |
| No of Example 1 | Tensile strength, kg 2 | Degree of swelling, % 3 | Tensile strength, % 4 | Degree of swelling, % 5 | 6 |
| 4 | 4.95 | 35.5 | 152.5 | 59.6 | 102.0 |
| 5 | 4.70 | 36.0 | 145.0 | 60.5 | 99.0 |
| 6 | 4.15 | 42.5 | 128.0 | 71.4 | 87.4 |
| 7 | 4.15 | 43.0 | 128.0 | 72.3 | 87.4 |
| 8 | 5.0 | 31.1 | 154.0 | 52.3 | 105.0 |
| 9 | 5.0 | 31.2 | 154.0 | 52.4 | 105.0 |
| 10 | 4.5 | 44.5 | 138.0 | 74.8 | 94.6 |
| 11 | 4.3 | 42.0 | 132.0 | 70.6 | 90.5 |
| 12 | 4.2 | 42.5 | 129.0 | 71.4 | 88.5 |

EXAMPLE 13

Absorbable surgical threads according to the invention were produced in the following way.

2.4 kg of complex viscose threads having a size of 60/18 and a tensile strength of 5.95 kg were oxidized and further treated in accordance with the procedure described in Example 1.

Properties of the oxidized non-treated threads:

| | |
|---|---|
| content of carboxyls, % | 9.0 |
| content of fixed nitrogen, % | 0.1 |
| relative humidity, % | 9.0 |
| tensile strength, kg | 4.05 |
| degree of swelling in water, % | 57.6 |

The conditions of the treatment were as follows:

| | |
|---|---|
| protophilic solvent | 4% acetic acid |
| time of holding, hours | 2 |
| temperature of heat treatment, °C. | 80 |
| time of heat treatment, hours | 1.5 |

The properties of the oxidized treated threads were as follows:

| | |
|---|---|
| tensile strength, kg | 5.35 |
| degree of swelling, % | 45.0 |
| ratio between the value of the tensile strength of the oxidized treated threads to the value of the tensile strength of the oxidized non-treated threads, % | 132.0 |
| ratio between the value of the degree of swelling of the oxidized treated threads and the value of the degree of swelling of the oxidized non-treated threads, % | 78.0 |
| ratio between the value of the tensile strength of the oxidized treated threads to the value of the tensile strength of the initial threads, % | 90.0 |

EXAMPLES 14–23

Absorbable surgical threads were produced according to the method of the present invention.

2.4 kg of high-modull viscose having a size of 20/6 and a tensile strength of 5.60 kg were oxidized and further treated in accordance with the procedure described in Example 1.

The properties of the oxidized non-treated threads were the following:

| | |
|---|---|
| content of carboxyls, % | 5.5 |
| content of fixed nitrogen, % | 0.1 |
| relative humidity, % | 7.6 |
| tensile strength, kg | 4.45 |
| degree of swelling in water, % | 61.0 |

| | | Treatment conditions | | |
|---|---|---|---|---|
| No of example | Protophilic solvent | Time of holding, hours | Temperature of treatment, °C. | Time of treatment, hours |
| 14 | dimethyl sulfoxide | 2.0 | 80 | 2.0 |
| 15 | dimethyl formamide | 2.0 | 90 | 1.0 |
| 16 | dimethyl formamide | 1.5 | 80 | 1.5 |

-continued

| | | Treatment conditions | | |
|---|---|---|---|---|
| No of example | Protophilic solvent | Time of holding, hours | Temperature of treatment, °C. | Time of treatment, hours |
| 17 | dimethyl formamide | 1.0 | 70 | 2.0 |
| 18 | dimethyl sulfoxide | 2.0 | 90 | 1.0 |
| 19 | dimethyl sulfoxide | 1.5 | 80 | 1.5 |
| 20 | dimethyl sulfoxide | 1.0 | 70 | 2.0 |
| 21 | dimethyl acetamide | 2.0 | 90 | 1.0 |
| 22 | dimethyl acetamide | 1.5 | 80 | 1.5 |
| 23 | dimethyl acetamide | 1.0 | 70 | 2.0 |

| | | | Properties of the oxidized treated threads: | | |
|---|---|---|---|---|---|
| | | | Ratio between the indices of oxidized treated threads and the indices of oxidized non-treated threads | | Ratio between the value of the tensile strength of oxidized non-treated threads and the tensile strength of initial threads, % |
| No of Example | Tensile strength, kg | Degree of swelling, % | Tensile strength, % | Degree of swelling, % | |
| 14 | 5.85 | 38.0 | 131.5 | 62.2 | 104.5 |
| 15 | 5.2 | 42.0 | 127.0 | 68.8 | 93.7 |
| 16 | 5.3 | 42.0 | 119.0 | 68.8 | 94.7 |
| 17 | 5.25 | 43.0 | 118.0 | 70.5 | 94.5 |
| 18 | 5.85 | 38.0 | 131.5 | 62.3 | 104.5 |
| 19 | 5.8 | 38.5 | 130.2 | 63.1 | 103.5 |
| 20 | 5.85 | 38.0 | 131.5 | 62.3 | 104.5 |
| 21 | 5.25 | 42.0 | 118.0 | 68.8 | 94.5 |
| 22 | 5.4 | 40.0 | 121.5 | 65.6 | 96.6 |
| 23 | 5.3 | 41.5 | 119.0 | 68.0 | 94.7 |

While particular embodiments of the invention have been shown and described, various modifications thereof will be apparent to those skilled in the art and therefore it is not intended that the invention be limited to the disclosed embodiments or to the details thereof and the departures may be made therefrom within the spirit and the scope of the invention as defined in the claims.

We claim:

1. A method of making absorbable surgical threads consisting in oxidizing cellulose threads with nitrogen oxides, washing said threads with water and treating the threads with a protophilic solvent for 1 to 2 hours at room temperature, removing from the solvent and holding the said threads at a temperature of 70° to 90° C. for 1 to 2 hours.

2. A method according to claim 1, wherein the protophilic solvent may be a 2 to 10% aqueous solution of an iogenic compound selected from the group consisting of sodium chloride, calcium chloride, calcium acetate and acetic acid.

3. A method according to claim 1, wherein the protophilic solvent may be a 2 to 10% aqueous solution of an amphiprotionic polyhydric alcohol selected from the group consisting of glycerol, pentaerytritol, mannite, sorbitol, glucose, saccharose and dextrose.

4. A method according to claim 1, wherein the protophilic solvent may be an organic solvent selected from the group consisting of dimethyl formamide, dimethyl sulfoxide and dimethyl acetamide.

* * * * *